US005820209A

United States Patent [19]

Weber

[11] Patent Number: 5,820,209

[45] Date of Patent: Oct. 13, 1998

[54] ADJUSTABLE HEIGHT SEATING SUPPORT

[76] Inventor: Trena O. Weber, 520 Blackwelder Rd., Statesville, N.C. 28677

[21] Appl. No.: 740,705

[22] Filed: Nov. 1, 1996

Related U.S. Application Data

[63] Continuation of Ser. No. 531,388, Sep. 21, 1995, abandoned.

[51] Int. Cl.[6] ..... A47C 4/52

[52] U.S. Cl. ..... 297/183.3; 297/452.21

[58] Field of Search ..... 297/183.3, 183.2, 297/183.1, 183.4, 183.6, 183.8, 440.1, 452.22, 452.41, 452.21, DIG. 3, 337, 338, 423.41, 423.45, 423.46, 313; 5/655, 657, 630, 632, 634

[56] References Cited

U.S. PATENT DOCUMENTS

D. 330,978 11/1992 Vasquez .
2,199,479 5/1940 Cappel .
2,623,574 12/1952 Damsch .
4,824,174 4/1989 Dunn .
4,836,605 6/1989 Greenwood et al. .
4,905,332 3/1990 Wang .
4,987,625 1/1991 Edelson .
5,005,902 4/1991 Farnworth et al. .
5,103,514 4/1992 Leach .
5,115,529 5/1992 White .
5,203,613 4/1993 Ward .
5,261,134 11/1993 Matthews .
5,360,360 11/1994 Peterson .
5,392,785 2/1995 Donahue .

*Primary Examiner*—Milton Nelson, Jr.

[57] ABSTRACT

A seating support is provided to assist children or others in a sitting position and includes a somewhat c-shaped cushion with a pivotable handle attached thereto. When not in use the handle can be used for carrying the seating support and during use the handle can be folded and the cushion positioned at a variety of heights and held in place by fasteners.

11 Claims, 3 Drawing Sheets

ADJUSTABLE HEIGHT SEATING SUPPORT

This is a continuation of application Ser. No. 08/531,388 filed 21 Sep. 1995, now abandoned.

FIELD OF THE INVENTION

A seating cushion is useful in maintaining back support for a child in the sitting position. The device herein described consists of a cushion with a handle which allows the user to adjust the vertical height of the cushion along the back of the child for optimum support and comfort.

BACKGROUND AND OBJECTIVES OF THE INVENTION

Children that are born with spinal defects or suffer back or spinal injuries benefit greatly from cushion supports that assist them in maintaining a proper sitting position. Cushions have been used for many years for this purpose, certain of which have a c-shape to allow the child to sit in the central opening with the rear inner cushion walls providing support to the child's back. Such cushions generally do not have handles and are somewhat difficult to carry, especially if the child is carried at the same time, for example, when taking the child and cushion from one room to another. Also, as the child grows, it would be desirable to increase the height of the cushion support for an older, taller child.

Thus, with the problems and disadvantages of conventional support cushions, the present invention was conceived and one of its objectives is to provide a seating support which is easy to carry and which is comfortable for the user.

It is another objective of the present invention to provide a c-shaped cushion with a foldable handle affixed thereto.

It is yet another objective of the present invention to provide a seating cushion in which the height can be adjusted.

It is still another objective of the present invention to provide a seating support with auxiliary fasteners attached to the handle and to the cushion.

Various other objectives and advantages of the present invention will become apparent to those skilled in the art as a more detailed description is set forth below.

SUMMARY OF THE INVENTION

A seating support is provided for disabled and other children or adults that require support in maintaining a sitting posture. A c-shaped cushion is provided having a carrying handle which extends rearwardly and which can be folded downwardly, beneath the cushion in various positions to adjust the height of the cushion along the back of the child sitting therein. Means to maintain the handle along the bottom of the cushion at the selected location includes male and female snap fastener sections whereby the height of the cushion can be adjusted for optimum comfort and benefit. The cushion and handle are formed from a durable fabric and are filled with poly-fibers, polyurethane, down or other conventional materials. The handle provides a convenient carrying method and when in use allows the height of the cushion to be properly adjusted for the specific user. The cushion may have a zippered cover which can be removed for washing or cleaning purposes.

DETAILED DESCRIPTION OF THE PREFERRED EMBODIMENT

Figure 4:
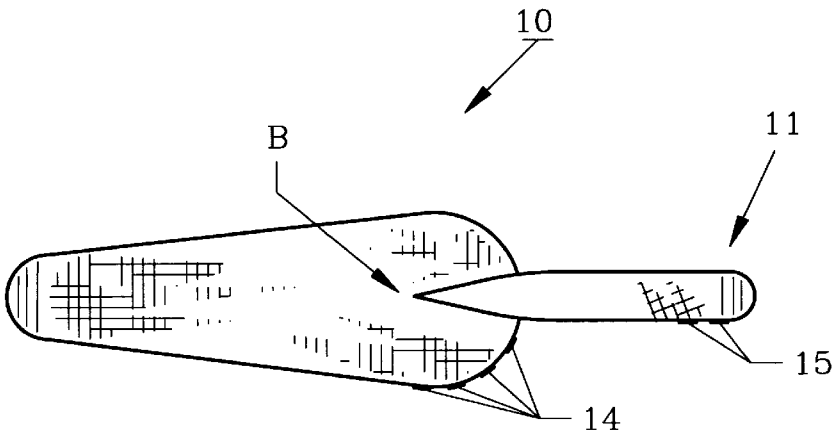
FIG. 4 pictures a side view of the seating support as shown in FIG. 1.
Figure 1:
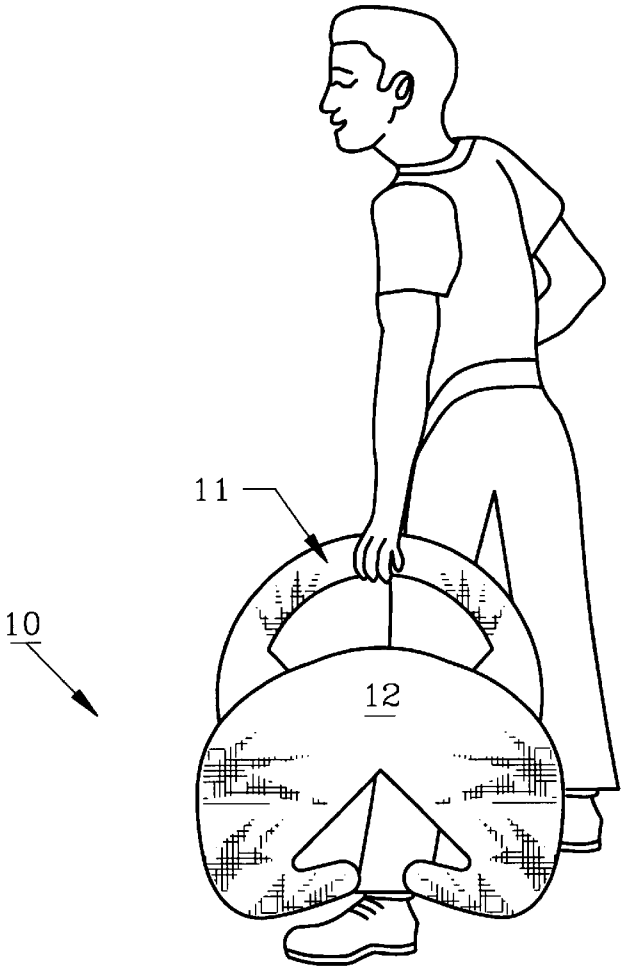
FIG. 1 demonstrates the seating support of the invention as manually carried.
Figure 2:
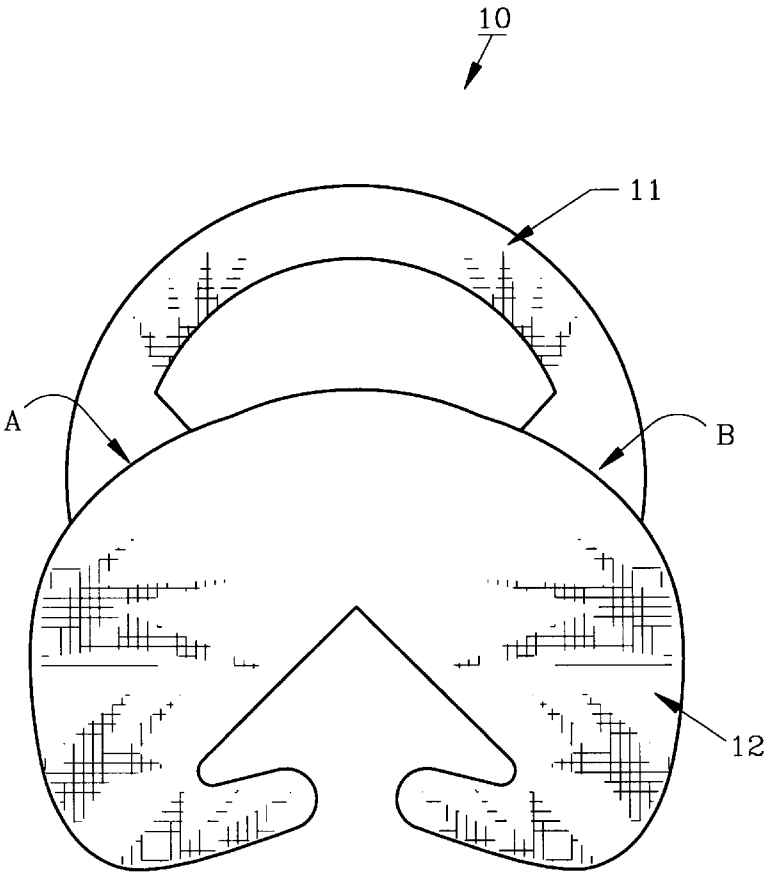
FIG. 2 shows the seating support of claim 1 in a top view.
Figure 3:
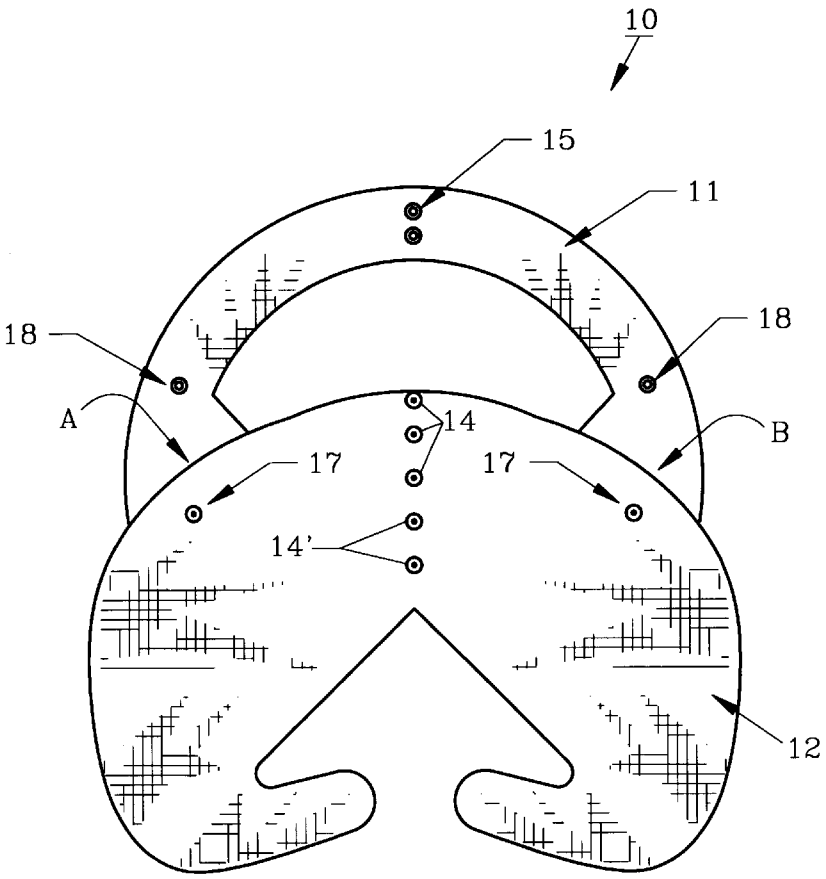
FIG. 3 illustrates the seating support as shown in FIG. 1 in a bottom view.

For a better understanding of the invention and its operation, turning now to the drawings, FIG. 1 shows seating support 10 as carried by pivotal u-shaped handle 11 joined to cushion 12 which has a somewhat c-shape and is tapered as will be hereafter explained in more detail. FIG. 2 illustrates a top view of the seating support 10 with handle 11 shown extended as in FIG. 1. In FIG. 3, a bottom view of seating support 10 with auxiliary male snap sections 14, 14' are seen which are selectively positioned for engagement with auxiliary female snap sections 15 on handle 11. Male snap sections 17 engage female snap sections 18 also shown on handle 11. Male snap sections 14 and 14' and female snap section 15 provide additional auxiliary means to attach handle 11 to cushion 12 as handle 11 is primarily and permanently joined to cushion 12 at the ends such as by sewing or the like along areas A and B as seen at FIGS. 2 and 3. Cushion 12 and handle 11 are formed from fabric and are filled by polyurethane foam, poly-fibers, down or other conventional filling materials as are used in the cushion trade.

As shown in FIG. 3, cushion 12 defines bight portion 35, legs 31 and 31', and bottom 30, to which a row of male snap sections 14 and 14' is attached. As illustrated, the row of male snap sections 14 and 14' is substantially parallel to legs 31 and 31' of C-shaped cushion 12. As also shown in FIG. 3, handle 11 further includes lower surface 34, to which female snap sections 15 are attached.

Figure 5:
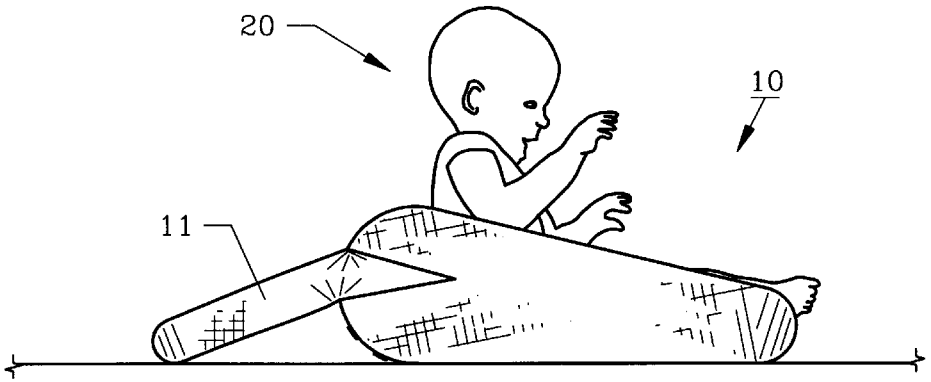
FIG. 5 features the seating support as shown in FIG. 1 placed on the floor with a child positioned therein.
Figure 6:
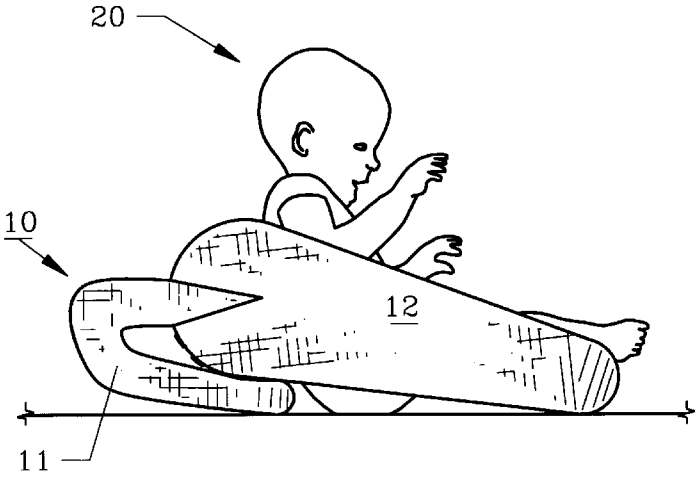
FIG. 6 depicts the seating support with the cushion raised by the handle affixed therebeneath.

Children with spinal disabilities, back and hip problems frequently have trouble maintaining a sitting posture. In FIG. 5, seating support 10 is seen with handle 11 extending rearwardly from cushion 12 with child 20 positioned therein. Cushion 12 will provide only minimal height support along the back of child 20. In FIG. 6, handle 11 has been folded downwardly along areas A and B, under cushion 11, with snap sections 15 attached to male snap sections 14 to raise cushion 12 upwardly, along the back of child 20.

Figure 7:
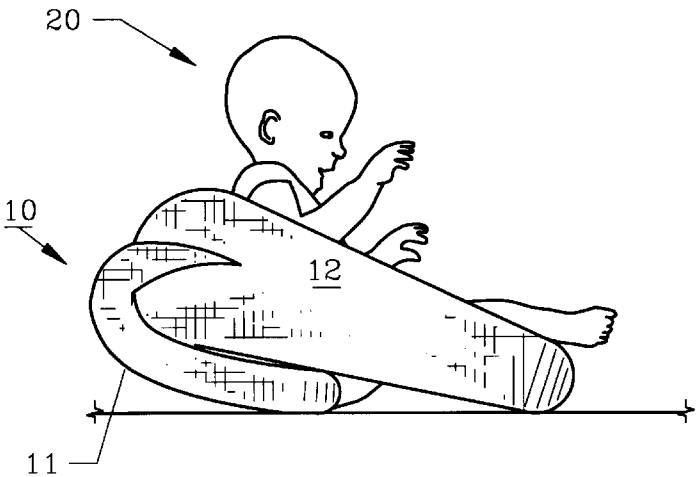
FIG. 7 shows the seating support raised a greater height along the back of the user than as shown in FIG. 6.

In FIG. 7, handle 11 has been folded beneath tapered cushion 12 a greater degree than shown at FIG. 6 to raise cushion 12 a greater vertical height, to provide a higher back support. In the posture shown at FIG. 7, snap fastener sections 15 are engaged with male snap fastener sections 14'.

As would be understood by those skilled in the art, various other cushions or types of fasteners could be used, other than snaps, and may include buttons, VELCRO, or other types of connectors. Thus, the illustrations shown herein are merely for explanatory purposes and are not intended to limit the scope of the appended claims.

I claim:

1. An adjustable height seating support comprising:

(a) a C-shaped cushion, said cushion defining two legs and a bight, said cushion having a row of first gender-specific fasteners, said row of first gender-specific fasteners being generally parallel to the legs of said cushion;

(b) a handle, said handle having two ends, the ends of said handle engaging said bight, said handle pivotable from a carrying position to a folded position beneath said cushion to raise said cushion, and a row of opposite gender-specific fasteners positioned on said handle, said first gender-specific fasteners being selectively engagable with said opposite gender-specific fasteners to raise said cushion.

2. The seating support of claim 1 wherein said first gender-specific fasteners comprise snap fasteners.

3. The seating support of claim 1 wherein said opposite gender-specific fasteners comprise snap fasteners.

4. The seating support of claim 1 wherein said cushion is tapered.

5. The seating support of claim 1 wherein said handle is u-shaped.

6. A seating support comprising: a tapered, C-shaped cushion for surrounding the lower back area of a person in a sitting position, said cushion defining two legs and a bight, said cushion having a row of first gender-specific fasteners, said row of first gender-specific fasteners being generally parallel to the legs of said cushion, a handle, said handle having two ends, the ends of said handle engaging said bight, said handle having a row of opposite gender-specific fasteners, said row of opposite gender-specific fasteners being selectively engagable with said first gender-specific fasteners to raise said cushion, said handle pivotable from a carrying position to a folded position beneath said cushion to thereby selectively elevate said cushion.

7. The seating support of claim 6 wherein said first gender-specific fasteners comprise a male snap fastener section and said opposite gender-specific fasteners comprise a female snap fastener section.

8. The seating support of claim 6 wherein said first and said opposite gender-specific fasteners comprise snap fasteners.

9. An adjustable height seating support comprising:

(a) a tapered, C-shaped cushion, said cushion defining two legs and a bight, said cushion having a bottom, a row of first gender-specific fasteners, said row of first gender-specific fasteners being positioned along the bottom, said row of fasteners being generally parallel to the legs of said cushion; and (b) a U-shaped handle, said handle comprising two ends, a base, said base positioned between said ends, said ends of said handle engaging said bight, said handle having a lower surface, said handle hingeable from a carrying position to a folded position beneath said cushion, a row of opposite gender-specific fasteners, said row of opposite gender-specific fasteners being positioned along the lower surface proximate the base of said handle;

whereby the height of said cushion can be raised by folding said handle downwardly beneath said cushion, selectively positioning the lower surface of said handle beneath the bottom of said cushion, sliding said handle relative to and further beneath said cushion until the desired cushion height is reached, and engaging said first gender-specific fastener on said bottom of said cushion with said opposite gender-specific fastener on said lower surface of said handle.

10. The support of claim 9, wherein said first gender-specific fastners comprise snap fastners.

11. The support of claim 9, wherein said opposite gender-specific fastners comprise snap fastners.

* * * * *